United States Patent [19]

Morris

[11] 4,110,927

[45] Sep. 5, 1978

[54] SPENT LONG GUN SHELL CADDY

[76] Inventor: Jack LeRoy Morris, 1513 W. 151 St. Ter., Olathe, Kans. 66061

[21] Appl. No.: 771,794

[22] Filed: Feb. 24, 1977

[51] Int. Cl.[2] ..... F41C 27/00

[52] U.S. Cl. ..... 42/1 T

[58] Field of Search ..... 42/1 T; 89/33 F

[56] References Cited

U.S. PATENT DOCUMENTS

| | | | |
|---|---|---|---|
| 1,304,468 | 5/1919 | Fernandez | 42/1 T |
| 3,153,296 | 10/1964 | Hofstetter | 42/1 T |
| 3,153,981 | 10/1964 | Brass | 42/1 T |
| 3,771,248 | 11/1973 | Linehan | 42/1 T |
| 4,028,834 | 6/1977 | Dobson | 42/1 T |

*Primary Examiner*—Charles T. Jordan

*Attorney, Agent, or Firm*—Clarence A. O'Brien; Harvey B. Jacobson

[57] ABSTRACT

An upstanding hollow receptacle is provided including interconnected opposite sides, opposite ends and top and bottom wall portions. The upper portion of one of the sides has a horizontal opening formed therein and the bottom of the receptacle is provided with an outlet opening closable by means of a slide fastener. In addition, support straps are carried by the receptacle on the side thereof defining the horizontal opening and the straps may be secured about the receiver and/or barrel portions of a long gun with the receptacle disposed on the side of the receiver from which spent shells are ejected with the horizontal opening disposed in position to receive shells being ejected from the receiver. The receptacle is constructed of flexible material supported by means of a frame over which the upper portion of the receptacle is disposed. The frame includes horizontal outwardly projecting abutment portions for abutting supportive engagement with the adjacent side surfaces of the receiver and/or barrel of the associated long gun with the receptacle spaced outwardly from the receiver to provide clearance for the rearwardly shiftable forearm grip and pump action actuator of a pump-type long gun with which the receptacle is operatively associated and also clearance for the finger engageable actuator of the bolt of a semi-automatic gun and loading of various types of guns including rifles.

7 Claims, 4 Drawing Figures

SPENT LONG GUN SHELL CADDY

BACKGROUND OF THE INVENTION

Various forms of receptacles for spent shells ejected from long guns have been heretofore provided. However, most of these receptacles have been constructed for use in conjunction with specific types of long guns. some forms of shell receptacles are specifically adapted for use with bolt action long guns while other receptacles are specifically adapted for use in conjunction with semi-automatic or pump action guns.

However, a need exists for a spent shell receptacle which may be utilized in conjunction with various forms of long guns and in particular for use in conjunction with shot guns of the semi-automatic and pump action types.

In the recent past,several governing authorities have or are seriously considering passing laws requiring the use of steel shot loads in shot gun shells used for hunting water fowl. As a result, the cost of new shot gun shells having steel shot loads will be increased and the expected increase will be such to make roloading of shot gun shells even more attractive from an economy standpoint, the expected increase in the cost of steel shot purchased in bulk quantities for reloading purposes being considerably less than the increase in cost of new shot gun shells equipped with steel shot loads.

Various forms of spent shell receptacles for use in conjunction with different types of long guns and which include some of the general structural and operational features of the instant invention are disclosed in U.S. Pat. Nos. 663,262, 1,304,468, 1,346,329, 3,153,981, 3,156,991 and 3,618,458.

BRIEF DESCRIPTION OF THE INVENTION

The spent shell receptacle of the instant invention is adapted for use in conjunction with bolt action, semi-automatic and pump action long guns and further may be used in conjunction with shot guns as well as rifles. The shell caddy of the instant invention includes a receptacle constructed of flexible material and a support frame including a first portion over which the receptacle is secured and a second portion designed to support the receptacle in spaced relation relative to the side of the receiver of an associated long gun from which spent shells are to be laterally ejected. The receptacle includes a horizontal opening in the upper portion of one side thereof for receiving spent shells ejected from the associated long gun and the bottom of the receptacle includes an opening removably closable by means of a slide fastener operatively associated therewith. In addition, the second portion of the support frame for the receptacle has adjustable length eleatic strap structures supported therefrom for encircling the receiver and/or barrel portions of the associated long gun whereby the caddy may be operatively supported from an associated long gun with the opening formed in one side thereof opening outwardly toward the point of lateral ejection of spent shells from the receiver of the associated long gun.

The structure of the support frame is such that the receptacle will be supported in spaced relation relative to the receiver of the associated gun and such that clearance will be provided for a rearwardly shiftable forearm grip of a pump action long gun.

The main object of this invention is to provide a long gun shell caddy which may be utilized on bolt action, semi-automatic and pump action guns.

Another object of this invention is to provide a spent shell caddy including mounting structure therefor readily adaptable for support from long guns of various manufacture.

Yet another object of this invention is to provide a long gun spent shell caddy from which collected spent shells may be readily removed.

A final object of this invention to be specifically enumerated herein is to provide a shell caddy in accordance with the preceding objects and which will conform to conventional forms of manufacture, be of simple construction and easy to use so as to provide a device that will be economically feasiable, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout

DETAILED DESCRIPTION OF THE INVENTION

Figure 1:
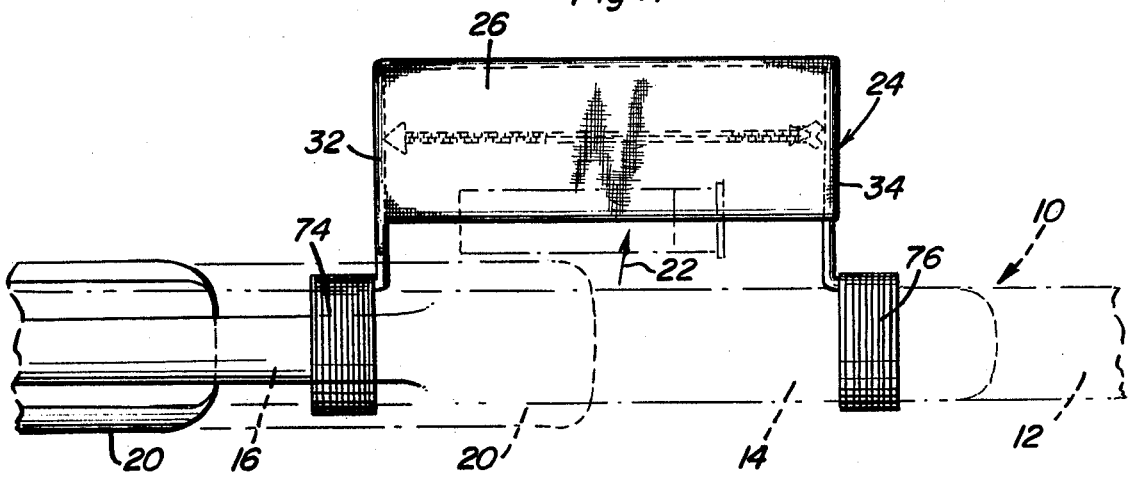
FIG. 1 is a top plan view of the shell caddy of the instant invention operatively associated with a pump action type of shot gun, portions of the shot gun being illustrated in phantom lines, together with an alternate forwardly displaced and shell ejecting position of the forearm grip of the pump action of the gun.

Referring now more specifically to the drawings, the numeral 10 generally designates a conventional form of pump action shot gun including a stock 12, a receiver 14 and a barrel 16. The gun 10 further includes a loading tube 18 from which a pump action operating forearm grip 20 is slidably mounted and the receiver 14 is operative to eject a spent shot gun shell horizontally outwardly from the receiver 14 in the direction indicated by the arrow 22 in FIG. 1 upon rearward displacement of the forearm grip 20 to the rearmost phantom line position thereof illustrated in FIG. 1.

The shell caddy of the instant invention is referred to in general by the reference numeral 24 and includes a hollow receptacle 26 including upstanding opposite side walls 28 and 30 interconnected by means of upstanding opposite end walls 32 and 34 and top and bottom walls 36 and 38. The bottom wall 38 has a longitudinal slot 40 formed therein selectively closable by means of a slide fastener 42. The receptacle is constructed of flexible material.

The caddy 24 further includes a support frame referred to in general by the reference numeral 44. The frame 44 includes a first upper horizontal portion 46 and a second vertical portion 48. The horizontal portion 46 includes a pair of elongated opposite side generally parallel members 50 and 52 interconnected at their opposite ends by means of horizontal transverse members 54 and 56. The ends of the first members 54 and 56 remote from the longitudinal member 50 project outwardly beyond the longitudinal member 52 and the vertical portion 48 of the frame 44 includes a pair of upstanding opposite end members 58 and 60 whose upper ends are secured to the extended ends of the transverse members 54 and 56 and whose lower ends are interconnected by means of a lower longitudinal member 62 extending therebetween.

The upstanding member 58 includes a lower end portion 64 which is offset toward the longitudinal member 50 relative to the upper end portion 66 of the upstanding member 58 and the longitudinal member 62 generally parallels the members 50 and 52, but includes an angulated and outwardly directed terminal end 68 on the end thereof remote from the lower end portion 64 to which the lower end of the upstanding portion 60 is secured.

The horizontal portion 46 of the frame 44 is received beneath the top wall 36 of the receptacle 26 and the portion of the top wall 36 overlying the longitudinal member 52 includes a downwardly and inwardly directed hem in which the longitudinal member 52 is secured. Further, the end walls 32 and 34 include portions thereof enclosing the upstanding members 58 and 60, respectively, and anchor tabs 70 and 72 are secured to those portions of the end walls 32 and 34 secured over the upstanding portions 58 and 60 and corresponding ends of a pair of elastic strap members 74 and 76 are secured to the tabs 70 and 72. The straps 74 and 76 include "Velcro" surfaces 78 and the tabs 70 and 72 include further "Velcro" surfaces 80 to which the surfaces 78 are releasably engageable in adjusted position.

Figure 2:
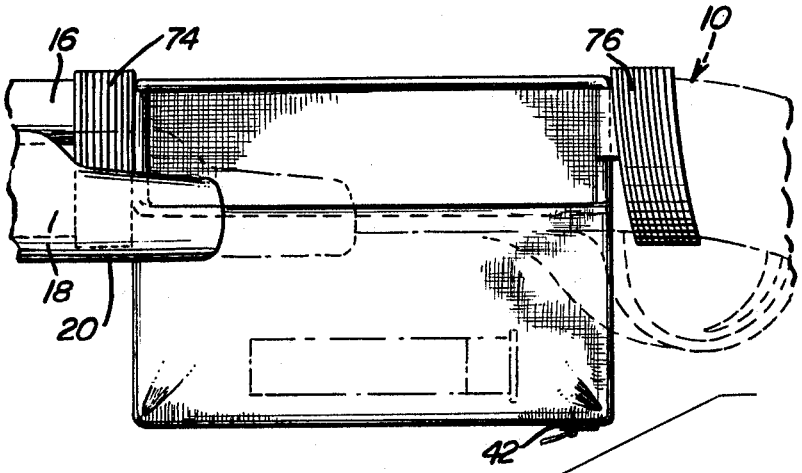
FIG. 2 is a side elevational view of the assemblage illustrated in FIG. 1 and with a partially rearwardly shifted position of the forearm grip illustrated in solid lines.
Figure 3:
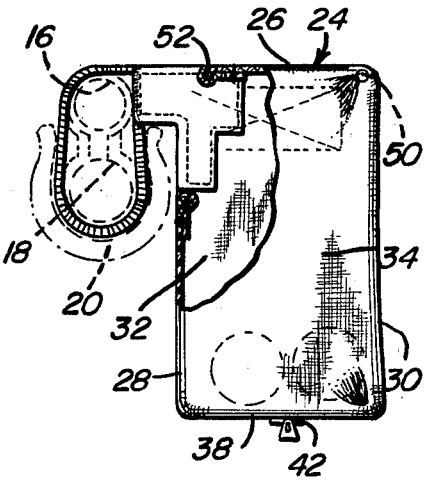
FIG. 3 is a rear elevational view of the shell caddy with portions of the rear end wall thereof being broken away.
Figure 4:
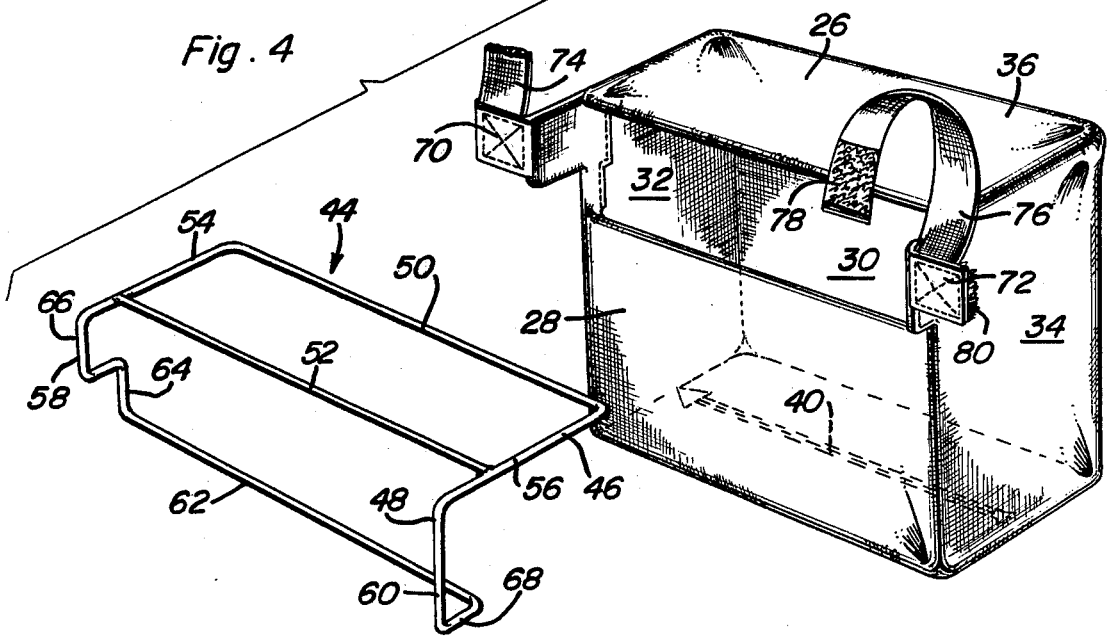
FIG. 4 is an exploded, perspective view of the gun caddy.

With attention now invited more specifically to FIGS. 1 and 3 of the drawings, it may be seen that the caddy 24 is positioned with the upper portion of the vertical member 48 abutting the right side of the receiver 14 rearward of the point of discharge of spent shells therefrom. Further, the upper portion 66 of the upstanding portion 58 is abutted against the right side of the barrel 16 forward of the receiver 14 and the straps 74 and 76 are secured about the barrel 16 and the tube and the receiver 14 in a manner which is believed to be obvious from FIGS. 2 and 3 of the drawings. It is pointed out, however, that the strap 74 passes about the tube 18 inward of the rear end of the forearm grip 20 comprising the operator portion of the pump action of the shot gun 10. Further, the lower end portion 64 of the upstanding portion 58 sufficiently outwardly offsets the lower end of the forward vertical portion 58 of the frame 44 from the tube 18 to provide clearance for that portion of the rear end of the forearm grip 20 on the right side of the gun 10 to be received between the receiver 14 and the receptacle 26. Accordingly, the caddy 24 may be readily utilized in conjunction with pump action shot guns.

It will further be noted from FIG. 1 of the drawings that the upstanding portions 58 and 60 of the vertical portion 48 of the frame 44 support the receptacle 26 sufficiently outwardly from the receiver 14 whereby a finger engageable operator of a semi-automatic shot gun projecting outwardly of the right side of the receiver 14 may be operated without interference with the receptacle 26. Still further, the spacing between the receiver 14 and the receptacle 26 provides ample clearance for loading a bolt action rifle, if the gun 10 was such a rifle.

After a quantity of shot gun or rifle shells have been collected in the receptacle 26, the collected shells may be removed from the bottom of the receptacle 26 merely by opening the slide fastener 42 and allowing the collected shells to fall from the receptacle.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a long gun of the type including a barrel extending forwardly from a receiver in which rounds to be fired from said gun may be received and further including structure for ejecting spent shells laterally outwardly of one side of said receiver, a spent shell catcher removably supported from said gun and defining a receptacle spaced laterally outwardly from and opening toward said one side of said receiver for receiving and catching spent shells ejected from said receiver, said receptacle including a hollow container including upstanding and interconnected near and far sides adjacent and remote, respectively, from said receiver, the upper portion of said near side defining an entrance opening into the interior of said container, said container further including a top side interconnecting the upper marginal portions of said near and far sides, said receptacle further including a support frame including an elongated horizontal upper portion and a horizontally elongated upstanding portion extending along and depending downwardly from one longitudinal edge of said upper portion, said upper portion of said frame underlying and supporting the marginal portions of said top side, said upstanding portion including opposite end upright portions for abutting the adjacent side surfaces of said gun.

2. The combination of claim 1 wherein said gun is of the pump action type and includes a front-to-rear slidably supported forearm grip portion comprising the actuator for said action, the rear portion of said grip portion being shiftable rearwardly to a position overlapping at least the forward portion of said receiver, said upright portions being spaced along said gun, the lower end portion of the forward upright portion being horizontally offset toward said far side to provide clearance for the adjacent rear portion of said grip portion during its rearward shifting movement relative to said receiver.

3. The combination of claim 2 wherein said upstanding portions include adjustable length strap means anchored thereto encircled about said gun and supporting said frame and thus said container from and in position relative to said gun.

4. The combination of claim 3 wherein said strap members are elastic.

5. The combination of claim 1 wherein said upstanding portions include adjustable length strap means anchored thereto encircled about said gun and supporting said frame and thus said container from and in position relative to said gun.

6. In combination with a long gun of the type including a barrel extending forwardly from a receiver in which rounds to be fired from said gun may be received and further including structure for ejecting spent shells laterally outwardly of one side of said receiver, a spent shell catcher removably supported from said gun and defining an elongated receptacle extending along and spaced laterally outwardly from and opening toward said one side of said receiver for receiving and catching spent shells ejected from said receiver, said receptacle defining a hollow container including upstanding and interconnected front to rear extending near and far sides adjacent and remote, respectively, from said receiver, the upper portion of said near side defining an entrance opening into the interior of said container, said container further including a top side interconnecting the upper marginal portions of said near and far sides, and opposite end front and rear sides extending between and interconnecting the front and rear ends, respectively, of said near and far sides, said front and rear sides including upper marginal portions thereof projecting outwardly beyond said near side and abuttingly engaged with said receiver and spacing said near side outwardly from said receiver, the outwardly projecting portion of said rear side being horizontally registered with and of substantially the same vertical extent as said entrance opening and the outwardly projecting portion of said front side being horizontally registered with and of less vertical extent than said entrance opening and terminating downwardly at a point spaced above the lower extremity of said opening to provide clearance for a rearwardly shifting outwardly projecting receiver operator.

7. The combination of claim 6 including a pair of adjustable length strap means carried by the opposite ends of said receptacle and encircled about said gun for support of said receptacle therefrom.

* * * * *